United States Patent [19]

Komplin

[11] Patent Number: 4,606,662

[45] Date of Patent: Aug. 19, 1986

[54] SINGLE STEPPING MOTOR RIBBON AND CORRECTION FEED AND LIFT SYSTEM

[75] Inventor: Steven R. Komplin, Lexington, Ky.

[73] Assignee: International Business Machines Corporation, Armonk, N.Y.

[21] Appl. No.: 696,990

[22] Filed: Jan. 31, 1985

[51] Int. Cl.[4] ..... B41J 35/22

[52] U.S. Cl. ..... 400/214; 400/216; 400/225; 400/229; 400/236; 400/697.1

[58] Field of Search ..... 400/208, 211, 212, 213, 400/213.1, 215, 214, 215.3, 216, 225, 229, 235, 236, 236.1, 697, 697.1

[56] References Cited

U.S. PATENT DOCUMENTS

| | | | |
|---|---|---|---|
| 3,863,749 | 2/1975 | Perry et al. | 400/213 |
| 3,871,507 | 3/1975 | Perry et al. | 400/208 |
| 4,010,839 | 3/1977 | Guerrini et al. | 400/208 |
| 4,302,118 | 11/1981 | Schaefer | 400/208 |
| 4,411,542 | 10/1983 | Wenderoth et al. | 400/697.1 |

FOREIGN PATENT DOCUMENTS

| | | | |
|---|---|---|---|
| 38215 | 10/1981 | European Pat. Off. | 400/208 |
| 58-191183 | 11/1983 | Japan | 400/214 |

OTHER PUBLICATIONS

"Unique Cam Arrangement for Printer Ribbon Feed Mechanism"; *IBM Tech. Disc. Bull.;* vol. 26, No. 1, pp. 67–68; B. D. Purcell et al; Jun. 1983.

"Variable Lift & Feed Increment Ribbon/Correction Mechanism"; *IBM Tech. Disc. Bull.;* vol. 26, No. 3B; pp. 1580–1582; G. L. Greenlief et al.

*Primary Examiner*—Edgar S. Burr
*Assistant Examiner*—David A. Wiecking
*Attorney, Agent, or Firm*—Laurence R. Letson

[57] ABSTRACT

A single stepping motor 10 driven to effect ribbon feed, ribbon lift, correction tape feed, correction tape lift is disclosed. The stepping motor 10 controls a cam 60/follower 64 pair to effect lift through a connection link 54 to a depending coupling 56 on the ribbon cartridge 22. The link 54 provides accurate positioning of the ribbon cartridge 22 without regard to the cam position and further transmits ribbon feed motion through to the depending coupling to the ribbon driver 30. Correction tape feed is effected through link 54 controlling the oscillation of the cartridges 22, 24 relative to a tape feed cam member 44.

6 Claims, 3 Drawing Figures

SINGLE STEPPING MOTOR RIBBON AND CORRECTION FEED AND LIFT SYSTEM

FIELD OF THE INVENTION

This invention relates to the field of ribbon and correction tape feed and lift systems and, more particularly, to a ribbon feed and correction tape feed in a system having oscillating cartridges.

RELATED APPLICATION U.S. patent application Ser. No. 696,689, filed, Jan. 31, 1985, on even date herewith, entitled "Correction Feed Mechanism in a Correction Tape Cartridge," by Steven R. Komplin and also assigned to International Business Machines Corporation of Armonk, N.Y., discloses and claims the correction tape cartridge used on the system disclosed herein.

Typewriters and printers having an oscillating cartridge system wherein the cartridges are oscillated about pivots to raise the span of exposed ribbon or correction tape to the print line require control of the oscillatory movement of the cartridge with a fairly high degree of accuracy to properly position the ribbon or correction tape precisely at the print line. Also, these typewriters and printers have a requirement for a feed mechanism which must accommodate the movement of the cartridge between a plurality of different positions while at the same time insuring accurate and proper feeding of the ribbon and/or correction tape.

Previous solutions to these problems have dictated separate drive mechanisms and lift mechanisms where the typewriter or printer utilize both a correction feed and a ribbon feed. The implementation of these separate drives results in duplication of parts and unnecessary expense, while the apparatus is more prone to malfunction.

Ribbon drives and correction tape drives for apparatus which utilize oscillating ribbon and correction tape cartridges have historically been more complex than for fixed cartridges due to the need to accommodate the oscillatory movement as well as to provide the drive movement to the ribbon and tape throughout the full range of oscillation. Examples of a feed and lift mechanism for a ribbon cartridge only are U.S. Pat. Nos. 3,863,749 and 3,871,507 to Donald S. Perry et al. These patents do not address a further need for correction tape feed and lift involving an oscillating correction tape cartridge.

To simplify drives for an oscillating cartridge ribbon-cartridge-tape-cartridge system and where more precise ribbon and correction tape feed control is desired, efforts have been made to mount the feed device on an oscillating support for the cartridges. The feed mechanism oscillates as well as the cartridge thus ovrcoming the variables of the oscillating cartridges and associated linkages and their relation to a non-oscillating feed mechanism. An example of such an oscillatable ribbon/-tape feed mechanism is U.S. Pat. No. 4,302,118 to John O. Schaefer and assigned to International Business Machines Corporation, Armonk, N.Y., the assignee of this invention. Accuracy of the feed increment is sacrificed in order to insure that an adequate feed increment is accomplished without regard to the oscillatory position of the cartridge.

SUMMARY OF THE INVENTION

A single frame mounted stepper motor drive provides both ribbon lift and correction tape lift, together with the forces necessary for ribbon feed and correction tape feed, by driving a follower against a cam which, in turn, controls the lift angle of the oscillatable cartridge assembly. When driven to a stop on the rotatable cam, the cam follower will rotate the cam to effect feed of the ribbon. The correction tape feed is controlled by the oscillation of the cartridge and the resulting cam controlled movement of a cam follower. The cam follower protrudes from the correction tape cartridge, and is engaged with and moved by a fixed cam surface on the member supporting the ribbon/tape feed mechanism and cartridges.

A stepper motor drives a follower which engages a face cam. The follower acts to displace the face cam axially to create a motion utilized to lift or allow the depression of the oscillatable cartridge assembly. The cam surface is discontinuous and has an abutting stop to which the follower may be driven and when the follower is driven into abutment with the stop surface, further rotation of the follower is effective to rotate the entire cam structure. In rotating the cam structure about its axis, it in turn transmits its motion to a link member which is engaged with interior channels within the cam body, forming in effect a type of constant velocity joint. The link through a similar engagement on the opposite end thereof acts to drive a hub which is a part of the ribbon driver of a ribbon cartridge mated thereto. This will effect the rotation of the ribbon driver incrementing the ribbon in response to the stepper motor actuation.

Ribbon lift is controlled by the face cam which is engaged by the follower. As the follower is rotated by the stepper motor, the cam is caused to rise, in turn pushing the link member, which then raises the rear of the cartridge. This acts to depress the ribbon from the print line, allowing for print line visibility. When the ribbon is to be raised, the follower is rotated to a lower portion of the cam rise, allowing the link and cam to fall and thereby lower the rear of the cartridge, thereby raising the span of exposed ribbon to the print line. The motive force for moving the cartridge to a raised ribbon position is a spring which engages the underside of the cartridge assembly and is deflected upon the forcible lowering of the ribbon and correction tape. Ribbon lift is precisely controlled without regard to the rotational position of the cam, through the connection of a central link member.

The precise feed control, which results in economy of use of the ribbon and correction tape, is accomplished by the implementation of the stepper motor drive which is capable of rotation in small increments and which may be controlled to produce varying feed increments for varying character widths. Additionally, with the ability to accurately control the cam follower rotation with the stepper motor, the cam rise corresponding to the elevation of the printing ribbon may be accessed at various points. This will provide for a multi-track ribbon where characters are printed at different positions on the printing ribbon resulting in additional economy.

ADVANTAGES OF THE INVENTION

The invention provides accurate control of the elevation of the printing ribbon to insure proper presentation of the ribbon at the print line while deriving the feed of the ribbon from the same drive source and drive train as provides the elevation of the ribbon.

The invention also provides the driving of a ribbon feed and a lift mechanism for a ribbon and correction tape from a single source while providing accurate feed increments and accurate positioning to enhance economy of ribbon usage.

The invention further provides a single unitary drive feed and lift mechanism for a ribbon system comprising a printing ribbon and a correction tape, thereby improving reliability of the mechanism.

The advantages of the invention are accomplished, and the disadvantages of the prior art overcome by the implementation of a single stepper motor drive/lift mechanism for a ribbon and correction tape system as will be more specifically described with reference to the following drawings.

DRAWINGS

DETAILED DESCRIPTION OF THE INVENTION

Figure 1:
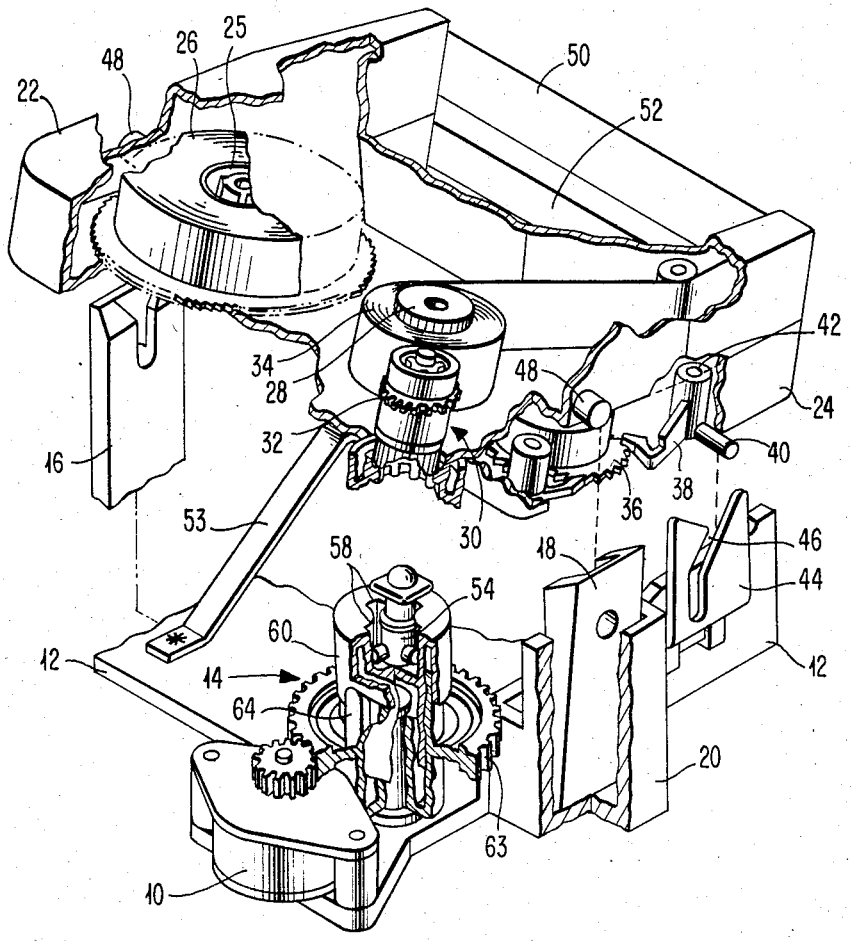
FIG. 1 is a partially exploded perspective view of the ribbon cartridge assembly including the ribbon drive portions thereof and the ribbon feed and lift mechanism.

The ribbon lift and feed apparatus disclosed herein utilizes a stepping motor 10 as a drive power source. The stepper motor 10 is mounted on a carrier frame 12 as is illustrated in FIG. 1. The carrier frame 12 typically transports, parallel to the print line, the ribbon lift and feed apparatus, ribbon cartridge 22, correction tape cartridge 24 and the implements of printing (not shown) necessary to effect printing.

The carrier frame 12 supports not only the stepping motor 10 but the ribbon feed and lifting mechanism 14. Carrier frame 12 likewise supports an upright 16 and latch 18 which is supported by latch support 20, a part of carrier 12. Upright 16 and latch 18 pivotally support ribbon cartridge 22 for oscillation.

Ribbon cartridge 22 in turn is the support for a depending correction tape cartridge 24. Ribbon cartridge 22 contains within its confines a supply spool 25, a ribbon disk 26 comprised of ribbon 50 wound on supply spool 25, a takeup spool 28 and a driver assembly 30. The driver assembly 30 comprises a spiked driver element 32 peripherally engaged with the disk of used ribbon 34 wound upon takeup spool 28. Takeup spool 28 is mounted in cartridge 22 to translate laterally as the size of disk 34 changes during use of ribbon 50.

Correction tape cartridge 24 contains a correction tape feed incrementing device comprising a ratchet 36, pawl member 38 and cam follower arm 40. Cam follower arm 40 protrudes through the side wall of cartridge 24. Cam follower arm 40 and pawl member 38 are integral with one another and pivotally mounted on pivot shaft 42, a part of the cartridge 24.

To move cam follower 40 and feed correction tape 52, cam member 44 is supported on the carrier frame 12 and positioned for effective coaction with cam follower 40. Cam member 44 defines a cam channel 46 formed therein. Cam channel 46 provides a path of movement to cam follower 40 as the cartridges 22, 24 are oscillated about the pivot studs 48 of cartridge 22.

To provide a force to oscillate cartridges 22, 24 about pivot studs 48 for raising ribbon 50 and correction tape 52, a spring 53 or other similar member is attached to the carrier frame 12 and is deflected as cartridges 22 and 24 are loaded into the upright 16 and latch 18. Spring 53, although illustrated as a leaf spring, may be a torsion or compression spring.

Figure 2:
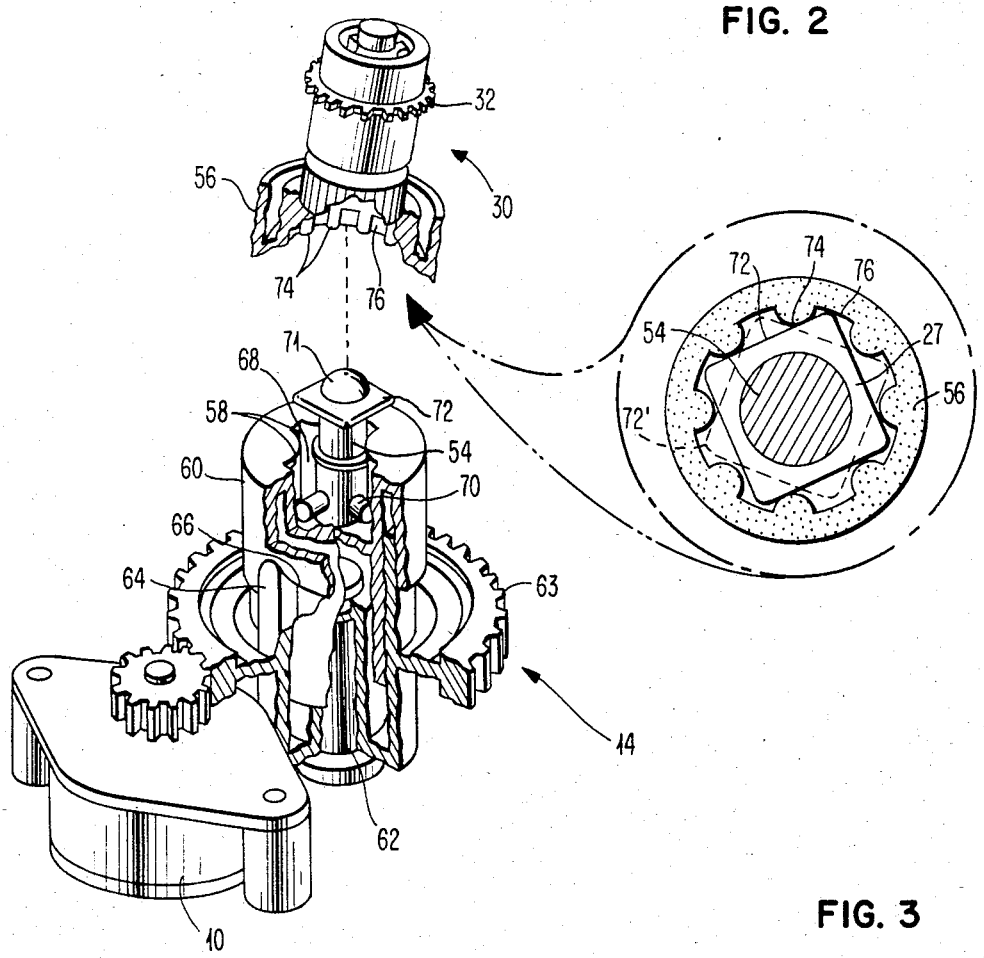
FIG. 2 illustrates the ribbon feed and lift mechanism of FIG. 1 in partially cutaway form for ease in understanding.

With reference to FIG. 2, in order to oscillate the cartridges 22, 24 about pivot studs 48, the ribbon feed/lift mechanism 14 is operated to effect a raising of link 54. Link 54 will transmit the raising movement created by ribbon feed/lift mechanism 14 to the hub 56 of ribbon driver assembly 30.

As link 54 pushes upward and moves hub 56 upward, the effect will be to depress ribbon 50 and correction tape 52 downward to reveal the print line. As the link 54 is relieved and allowed to lower itself due to the lowering of cam member 60, spring 53 will cause the cartridges 22, 24 to oscillate and raise the ribbon 50 and correction tape 52 toward the print line.

Shaft 62 supports the ribbon feed and lift mechanism 14 with respect to the carrier frame 12. Positioned over shaft 62 is a cam follower member 64 which is rotatable about shaft 62 by a gear 63 integral therewith. As stepper motor 10 operates, gear 63 will be rotated causing cam follower member 64 to rotate about the axis of shaft 62.

In order to derive axial movement of cam 60 to be transmitted to the cartridge 22, 24, cam member 60 is coaxially positioned over and circumscribing shaft 62. Cam member 60 has a face cam surface 66 formed as its lower surface which is engageable with cam follower member 64. The height of cam member 60 above carrier frame 12 is dependent upon the extent of rise of the cam surface 66 at the point of engagement with cam follower member 64.

In order to provide support to link 54 during lifting, an internal cavity 68 is formed into the central portion of cam member 60 such that it will accommodate link 54. Link 54 is formed with a plurality of short extensions 70 protruding substantially perpendicular to the axis of link 54 and proximate one end thereof for positioning within cavity 68. Cavity 68 is provided with channels 58 to restrict the rotatability of link 54 within cavity 68. Further, cavity 68 cofines the thrust against link 54 to the central axis of cam member 60. Thus the thrust does not shift from the axis of cam member 60 with changes in the vertical position of cam member 60. This consistent position results in more accurate ribbon lift positioning.

The opposite end of link 54 is formed into a hemispherical surface which acts as a bearing surface 71. A drive flange 72 is located immediately under the bearing surface 71. Drive flange 72 is formed in a plane substantially perpendicular to the axis of link 54 for coupling with hub 56 of cartridge 22.

As can best be seen in inset of FIG. 2, hub 56 is provided with a series of ridges 74 breaking the continuity of an interior cylindrical surface 76 formed in the bottom thereof. These ridges 74 act to define splines which are effective in constraining drive flange 72 relative to hub 56 and thereby accept the ribbon driving forces transmitted through flange 72. Dashed lines 72' show an alternatve position for flange 72. Hub 56 and flange 72 remain in driving contact at all angles assumed during the tilting of the assembly of cartridges 22 and 24.

Hub 56, being rigidly connected through the structure of the ribbon driver assembly 30 to spiked driver 32, will transmit the rotational movement of cam member 60 to the takeup ribbon disk 34, thereby winding used ribbon 50 onto the takeup spool 28.

Figure 3:
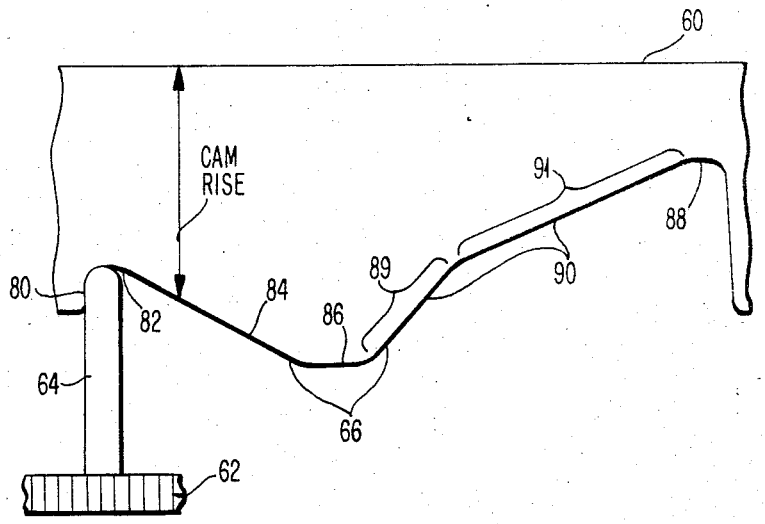
FIG. 3 is a linear diagramatic representation of the cam follower and the cam profile of the ribbon lift and feed mechanism.

To best understand the relationship between cam follower member 64 and cam member 60 for raising and lowering of cam member 60 and the rotation of cam member 60 about shaft 62, reference is made to FIG. 3, which is a developed two dimensional diagramatic representation of the cam surface 66 on the bottom of cam member 60 and cam follower member 64.

Cam surface 66 is wrapped around the cylindrical periphery of cam member 60 and, as such, relative left-right motion of the cam follower 64 as illustrated in FIG. 3 with respect to cam member 60 is in reality counterclockwise-clockwise rotary motion of the cam follower member 64 about shaft 62 as shown in FIG. 2. Beginning at the left portion of cam surface 66, there exists a substantially vertical surface which is a cam stop 80. Since the input to the cam member 60 is through the rotational movement of cam follower member 64 about shaft 62, the relative movement will be described as the movement of the follower 64 from left to right and right to left along the cam surface 66 causing displacement of the cam member 60 vertically. Cam stop 80 is a surface which is engaged by the follower to cause cam member 60 to rotate about the axis of shaft 62 to effect ribbon feed, to be discussed in more detail later.

The dwell 82 of cam surface 66 represents the ribbon print position at which the ribbon will be presented to the print line. This position is such that the ribbon 50 is at an intermediate height with respect to its limits of oscillatory travel. Ribbon 50 is lower than that position which would be occupied when the correction tape 52 is positioned at the print line and is higher than the position where ribbon 50 is withdrawn for operator visibility. Slope 84 serves a dual purpose in that it provides a surface for follower 64 to ride between dwell 82 and dwell 86 and further provides a plurality of possible ribbon lift positions where two or more tracks may be used on the ribbon for further ribbon economy.

Dwell 86 represents the highest position which cam member 60 will occupy and thus the highest position of the rear of the cartridge 22. With the rear of the cartridge 22 in this elevated position, ribbon 50 will be in its most depressed position, thereby affording operator visibility of the printed material on the print line. Dwell 86 therefore represents the print-line visibility position of the cartridge.

Dwell 88 corresponds to the lowest position cam member 60 will occupy with respect to follower 64 and thus will be the position corresponding to the lowest position of the rear of cartridge 22. With cartridge 22 oscillated into the position where the rear of cartridge 22 is at its lowest point, the correction tape cartridge 24 depending from the ribbon cartridge 22 will be raised to its highest position. The raised position corresponds to the position necessary to present correction tape 52 to the print line for correction.

The cam profile portion designated as slope 90 is the correction tape feed/reset profile and is divided into segments 89, 91. As the cam follower 64 moves from dwell 86 to dwell 88, cam follower 40, as shown in FIG. 1, will ride upward in cam channel 46, and move forward during the latter portion of the travel effectively resetting pawl member 38 relative to ratchet 36. As the follower 64 rides along profile 90 from dwell 88 toward dwell 86 during the lowering of the ribbon 50 and correction tape 52, the cartridge assembly 22, 24 will be oscillated. The so that cam follower 40 will move downward in cam channel 46 causing the displacement of follower 40 rearward. Pawl member 38 is thus rotated to drive ratchet 36 in a counterclockwise direction to increment correction tape 52. The more gradual slope of segment 91 is selected to minimize the forces during feed, so that inadvertent rotation of cam member 60 causing ribbon feed does not occur since the raising and lowering of the cam 60 necessarily includes forces tending to rotate cam 60. Such forces are too low to actually rotate cam 60 except when follower 64 drives stop 80. After feed of tape 52 has occurred, the component rotational force may be increased, as by the steeper slope of segment 89.

OPERATION

Stepping motor 10 is driven in discrete increments, depending upon the number of steps per revolution designed into the motor, in a conventional manner to control lift and feed of the ribbon 50 and tape 52, as can best be observed in FIG. 1.

Knowing the number of steps per revolution of the motor and the associated gear reduction ratio to drive gear 63, gear 63 and its connected assembly of parts constituting the ribbon feed/lift mechanism 14 may be accurately controlled through the movement of cam follower member 64. The position of follower 64 along the cam profile 66 (FIG. 3) may be accurately controlled by causing motor 10 to step a precise number of steps, thus allowing the impact of the ribbon at a plurality of levels by incrementing follower 64 only a small amount. This improves ribbon economy by better utilization, such as when printing repetitive underscores, periods or short letters. By rotating gear 63, follower 64 is moved along cam profile 66 to varying points, causing the vertical shifting of the cam member 60 along the axis of shaft 62.

Referring also briefly to FIG. 3, as follower 64 moves from rise 86, where the print line is visible to rise 82, the cartridge 22 will be oscillated about pivots 48 to present ribbon 50 at the print line in a desired position for printing. Before printing has occurred, which occurs with follower 64 on slope 84 or rise 82, follower 64 is moved leftward against cam stop 80 to effect rotation of the cam 60 for ribbon feed. This movement of follower 64 is leftward with respect to FIG. 3 and clockwise rotation with respect to FIGS. 1 and 2. To restore print line visibility, stepper motor 10 is reversed and driven a sufficient number of steps to rotate gear 62 to again place cam follower 64 on rise 86 so that the operator may observe the character or characters just printed. The rotation of cam member 60 is transmitted by link 54 to hub 56 on cartridge 22, thereby effecting the feeding of ribbon 50 by winding the used ribbon 50 onto takeup spool 28 to form a ribbon disk 34 prior to printing.

This sequence will be repeated as many times as necessary to accomplish the printing as required.

Upon the discovery of an error in the printed text, the stepper motor 10 is rotated step wise in the opposite direction from that used for ribbon lifting to move cam follower 64 along correction feed/reset profile 90 until such time as follower 64 engages rise 88 at which point the correction tape 52 is positioned adjacent the print line so that the impacting of a printing implement onto the correction tape 52 will effect correction of the erroneous character.

As the cam follower 64 traversed profile 90 enroute from rise 86 to rise 88, the feed mechanism of the correction tape cartridge 24 was conditioned, through the movement of follower 40 in a forward direction, to withdraw pawl member 38 and to position it for driving engagement with ratchet 36.

After the correction has occurred, cam follower 64 is rotated, by stepper motor 10, in the clockwise direction to traverse profile 90 to the visibility position rise 86. During the positive vertical driving of the cam member 60 upward resulting from the movement of follower 64 across rise 90, the cam follower 40 is moved rearward by cam member 44 to effect feed of the correction tape 52 during the engagement of follower 64 with segment 91.

Should additional corrections be required, the previous sequence of operations is repeated as necessary with the follower 64 being returned to rise 86 after each correction to effect tape feed and visibility.

Depending upon the cam profile of cam member 44, it may be necessary only to traverse segment 91 the profile 90 on cam member 60 in order to effect adequate feed when repetitive corrections are to be accomplished and visibility is not required. This results from the fact that once the ribbon cartridge 22 and depending correction tape 24 have been oscillated to lower the ribbon 50 to a point corresponding to its print position adjacent the print line, no further feed of the correction tape will occur since the profile of cam channel 46 is configured to prevent significant movement of follower 40 during the portions of oscillatory travel corresponding to raising the ribbon 50 to the print position and lowering it to the visbility position.

From the foregoing description of operation, it is apparent that the ribbon feeding will only occur as a result of positively driving cam member 60 through engagement of follower 64 with cam stop 80 and then displacing cam follower 64 a further increment. This feed is not present during correction cycles and therefore printing ribbon 50 is not wasted during correction cycles.

The force for raising of the ribbon cartridge 22 and the correction tape cartridge 24, whether it be for printing or for correction, is provided by spring 53 acting on the underside of the correction tape cartridge and forward of the axis between pivots 48. The raising is accomplished by relieving the force transmitted by link 54 to hub 56. Conversely, the lowering of the ribbons 50 and correction tape 52 is accomplished by exerting a force through link 54 greater than the force exerted by spring 53.

From the foregoing understanding of the ribbon feed/correction tape feed and lift mechanisms, it can be seen that the stepper motor 10 provides both feed and lift for the correction tape 52 and the ribbon 50 and at the same time accurately increments the ribbon 50 for economical consumption and is further capable of precise positioning of the ribbon 50 with respect to the print line to accommodate multiple printing tracks should a wide enough ribbon 50 be used. If a narrow ribbon 50 is used, the accuracy of vertical positioning of the ribbon 50 is crucial to insure that the printing implement impacts the ribbon 50 and does not overlap over the edge thereof and create a print failure. The accuracy of vertical positioning is controlled by utilizing a rigid link 54 which is centrally positioned to the cam member 60 thereby insuring a consistent spacial relationship between the input to link 54 and the hub 56 regardless of the rotational position of cam member 60.

The device is further highly reliable in comparison to prior art devices since there is a minimum number of parts which may malfunction and the parts that are required, in some cases provide a multiple of functions with respect to feed and lift for the ribbon, thereby eliminating redundant mechanical mechanisms.

Changes may be made in the implementation of the above invention without departing from the concept thereof.

I claim:

1. A ribbon feed and lift system for a printing device having an oscillating ribbon cartridge containing ribbon and an oscillating correction tape cartridge containing correction tape, said system comprising in combination:

a carrier including means thereon for permitting oscillation of at least said ribbon cartridge relative thereto; said ribbon cartridge having means for coupling said cartridge in pivoting relation relative to said carrier, said ribbon cartridge including ribbon feed driver means, said correction tape cartridge mounted with said ribbon cartridge, and ribbon feeding and oscillating means comprising a depending coupling mounted on said ribbon cartridge for rotating said ribbon feed driver means and thereby feeding said ribbon;

a cam and cam follower means, and a single drive power means coupled to one of said cam and cam follower means, the other of said cam and cam follower means being connected to said ribbon feedig and oscillating means for oscillating said ribbon cartridge about said pivot means; said cam comprising a profile defining multiple steps in oscillation of said ribbon cartridge about said pivot means thereby presenting said ribbon or tape for printing without effecting rotation of said coupling; and stop means on said profile of said cam for effecting rotation of said coupling commencing upon rotation of said cam follower a predetermined amount, to rotate said ribbon feed driver means.

2. A ribbon feed and lift system for a printing device in accordance with claim 1, including means on said cam for effecting additional lift to said ribbon cartridge to present said correction tape from said correction tape cartridge at an elevated position for effecting erasure of printed indicia.

3. The ribbon feed and lift system of claim 2 wherein said correction tape cartridge further comprises a feed means, comprising a cam follower, for incrementing said tape.

4. A ribbon feed and lift system in accordance with claim 3 including a second cam rigidly fixed to said carrier for cooperative engagement with said cam follower of said correction tape cartridge to effect feeding of said correction tape from oscillation of said tape cartridge.

5. The ribbon feed and lift system in accordance with claim 1 wherein said correction tape cartridge depends from said ribbon cartridge.

6. The ribbon feed and lift system in accordance with claim 4 wherein said correction tape cartridge depends from said ribbon cartridge.

• • • • •